US006481992B2

(12) United States Patent
Wong et al.

(10) Patent No.: US 6,481,992 B2
(45) Date of Patent: Nov. 19, 2002

(54) VANE PUMP

(75) Inventors: Albert Cheuk-Yin Wong, Saginaw, MI (US); Tom Cheuk-In Wong, Saginaw, MI (US); Johnny M. Paris, Clio, MI (US); Gary Ray Minnis, Saginaw, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/781,539

(22) Filed: Feb. 8, 2001

(65) Prior Publication Data

US 2001/0033803 A1 Oct. 25, 2001

Related U.S. Application Data

(60) Provisional application No. 60/181,871, filed on Feb. 11, 2000.

(51) Int. Cl.[7] ..... F04C 2/344

(52) U.S. Cl. ..... 418/132; 418/77; 418/81; 418/133

(58) Field of Search ..... 418/77, 81, 132, 418/133

(56) References Cited

U.S. PATENT DOCUMENTS

| | | | | |
|---|---|---|---|---|
| 2,653,550 A | | 9/1953 | Gardiner et al. | 418/133 |
| 3,523,746 A | * | 8/1970 | Dadian et al. | 418/132 |
| 3,664,776 A | | 5/1972 | Mills et al. | 418/133 |
| 3,964,844 A | * | 6/1976 | Whitmore et al. | 418/133 |
| 4,505,654 A | | 3/1985 | Dean, Jr. et al. | 418/133 |
| 5,171,131 A | | 12/1992 | Niemiec | 418/133 |
| 5,266,018 A | | 11/1993 | Niemiec | 418/133 |

FOREIGN PATENT DOCUMENTS

| | | |
|---|---|---|
| DE | 4326627 | 9/1995 |
| EP | 0959249 | 11/1999 |

* cited by examiner

*Primary Examiner*—John J. Vrablik
(74) *Attorney, Agent, or Firm*—Edmund P. Anderson

(57) ABSTRACT

A vane pump includes a cylindrical rotor rotatable inside of an oval-shaped rotor chamber defined by a cam ring around the rotor. A thrust plate and a pressure plate on opposite sides of the cam ring cover the rotor chamber and are squeezed together by a pressure force attributable to fluid in a discharge chamber of the vane pump at a discharge pressure thereof. A first thrust face of the thrust plate is pressed against an end wall of a cavity of a pump housing in which the components are installed. Fluid at the discharge pressure is ported to one or more balance chambers between the thrust plate and the end wall of the housing. The balance chambers are defined by a gasket received in a groove of the first thrust face. Fluid at the discharge pressure within the balance chamber balances a fraction of the pressure force on the thrust plate on an opposite second thrust face thereof attributable to fluid discharged from a rotor chamber in which the rotor operates, in order to place the thrust plate in axial static equilibrium.

11 Claims, 4 Drawing Sheets

VANE PUMP

CROSS-REFERENCE TO RELATED APPLICATION

This application is based upon, and claims the benefit of, United States Provisional Patent Application No. 60/181,871 filed Feb. 11, 2000, the disclosure of which are incorporated by reference herein in its entirety.

BACKGROUND OF THE INVENTION

1. Technical Field

This invention relates to vane pumps.

2. Related Art

A vane pump typically includes a cylindrical rotor supported for rotation inside of an oval-shaped rotor chamber defined by a cam ring surrounding the rotor. The cam ring and the rotor define crescent-shaped cavities therebetween which are divided in to a plurality of pump chambers by a corresponding plurality of flat vanes carried in radial vane slots of the rotor. The pump chambers expand into an inlet sector of the crescent-shaped cavities and collapse in a discharge sector of the cavities as the rotor rotates. A thrust plate and a pressure plate are disposed on opposite sides of the cam ring and are squeezed together under spring tension to cover the rotor chamber. An opposite thrust face of the thrust plate is pinned between the cam ring and end wall of the housing. A significant fluid pressure differential is developed across the thrust plate which induces flexure of the thrust plate away from the rotor toward the end wall. A clearance dimension between the housing, thrust plate, and rotor calculated to accommodate such flexure exceeds a corresponding clearance dimension needed for high volumetric efficiency. Fluid leakage from the pump chambers attributable to the extra clearance for flexure of the thrust plate reduces the volumetric efficiency of the vane pump.

U.S. Pat. No. 6,050,796 discloses a vane pump having a hydraulically balanced rotor for improving the efficiency of the pump. The present invention provides further improvements to vane pumps.

SUMMARY OF THE INVENTION AND ADVANTAGES

A vane pump constructed according to the invention comprises a pump housing having a longitudinal axis, a cavity for hydraulic fluid, and a substantially planar end wall of the housing which is exposed to the cavity. A thrust plate is disposed in the cavity having a first thrust face disposed in adjacent facing relation to the end wall of the housing, and an opposite second thrust face. The thrust face has at least one fluid inlet port communicating with the cavity. A pressure plate is disposed in the cavity in axially space relation to the thrust plate. A cam ring is disposed in the cavity between the thrust plate and pressure plate and has a circumferentially extending inner cam wall defining a rotor chamber of the cavity. A rotor is supported in the rotor chamber for rotation about the longitudinal axis of the housing relative to the inner cam wall of the cam ring. A plurality of vanes are slideably supported by the rotor for radial reciprocation in communication with the inner cam wall of the cam ring to define a plurality of dynamically expanding and diminishing volume sectors of the rotor chamber and which are operative to draw hydraulic fluid into the rotor chamber under low pressure and expel the hydraulic fluid under elevated pressure from the rotor chamber. A resilient gasket is disposed between the first thrust face of the thrust plate and the end wall of the housing to define a sealed balance chamber therebetween.

Provision of the balance chamber is operative to exert counteracting controlled fluid pressure on the first thrust face to oppose the fluid pressure exerted on the second thrust face so as to support the thrust plate in hydraulic equilibrium within the pump housing. The balance of fluid force on axially opposite sides of the thrust plate minimize or eliminate thrust plate flexure away from the rotor, allowing for tighter dimensional tolerance of the thrust plate and rotor which in turn lessens leakage of high pressure fluid past the thrust plate and lessens the loss of volumetric efficiency associated therewith. When combined with a hydraulically balanced rotor, a pump constructed according to the invention has been shown to improve volumetric efficiency by as much as 57% over traditional vane pumps without such balanced thrust plate and rotor components.

THE DRAWINGS

A presently preferred embodiment of the invention is disclosed in the following description and in the accompanying drawings, wherein.

DETAILED DESCRIPTION

Figure 1:
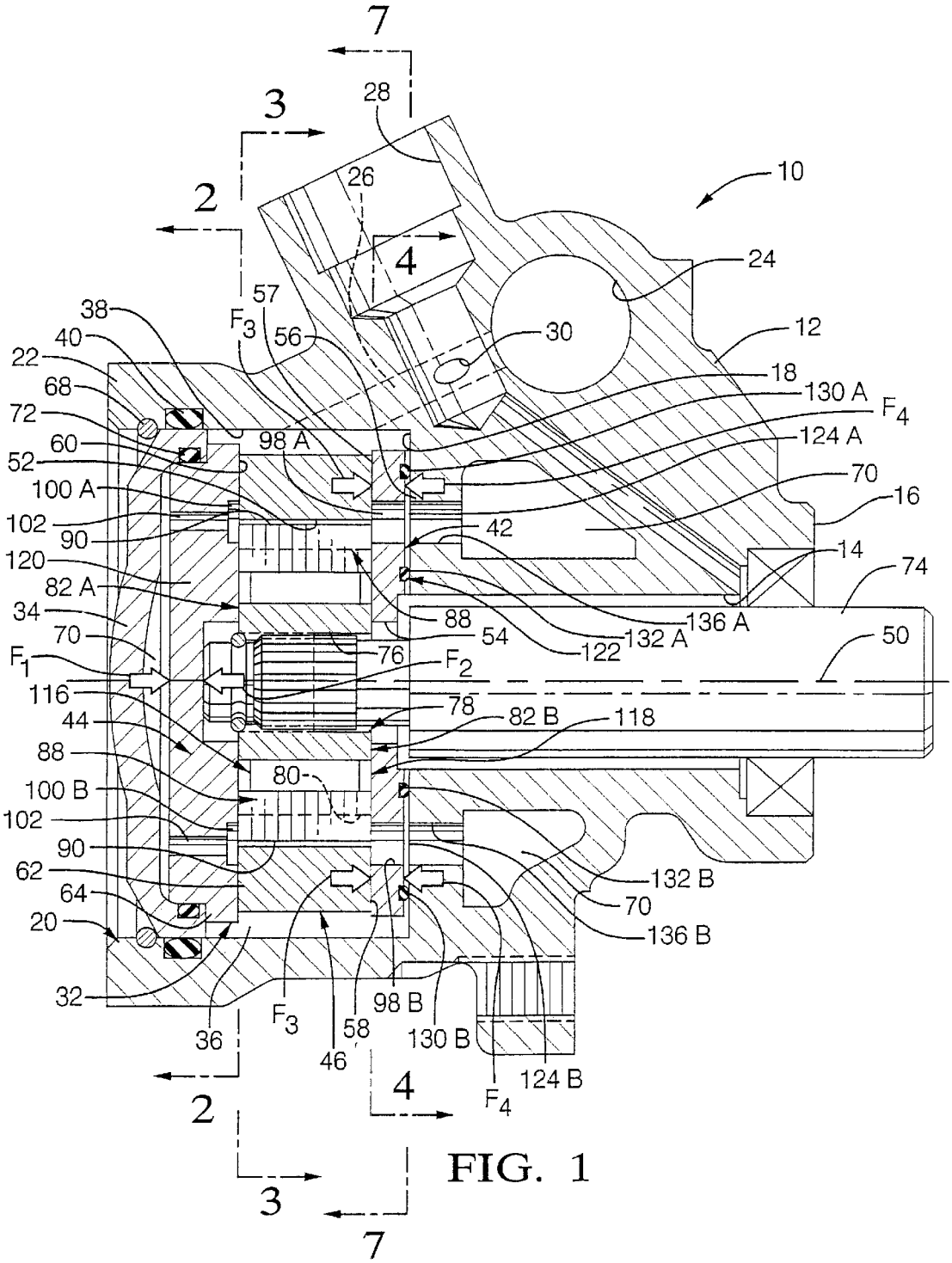
FIG. 1 is a longitudinal sectional view of a vane pump constructed according to the invention.

Referring now in more detail to the drawings, a vane pump 10 constructed according to the invention includes a pump housing 12 having therein a drive shaft bore 14 open through a first end 16 of the housing 12 and intersecting a flat bottom or end wall 18 of a large counter bore or cavity 20 in a second end 22 of the housing 12. A control valve bore 24 in the housing 12 communicates with the counter bore 20 through a schematically represented internal passage 26 in the housing 12. An inlet passage 28 in the housing 12 communicates with a reservoir of fluid (e.g., hydraulic fluid), not shown, and with the internal passage 26 through an aperture 30.

A "rotating group" 32 of the vane pump 10 is captured in the cavity 20 between the end wall and a disc-shaped cover 34 closing the open end of the cavity 20. An annular chamber 36 is defined between a cylindrical side wall 38 of the cavity 20 and the rotating group 32. A seal ring 40 suppresses fluid linkage between the housing 12 and the cover 34. The rotating group 32 is stationary relative to the pump housing 12 and includes a thrust plate 42 seated on the flat end wall 18 of the cavity 20, a pressure plate 44 spaced axially from the thrust plate 42, and a cam ring 46 disposed in the cavity 20 between the thrust plate 42 and the pressure plate 44. A plurality of dowel pins 48 traverse the thrust plate 42, pressure plate 44, cam ring 46, and the housing 12 and prevent relative rotational movement therebetween about a longitudinal center line or axis 50 of the pump housing 12.

Figure 3:
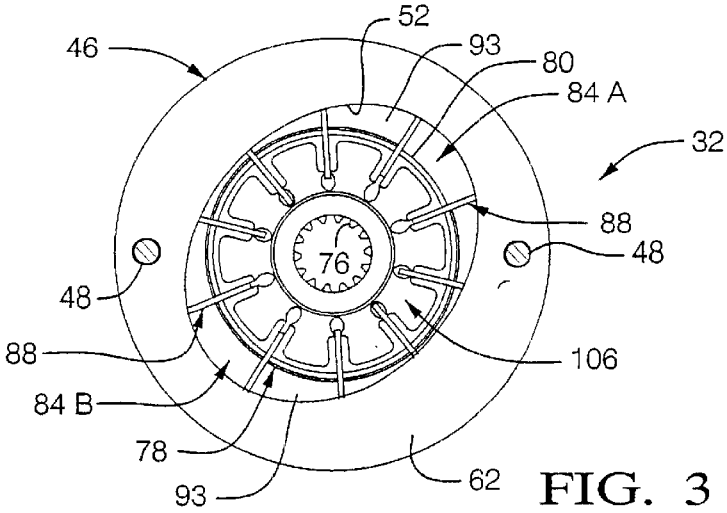
FIG. 3 is a sectional view taken generally along lines 3—3 of FIG. 1.
Figure 4:
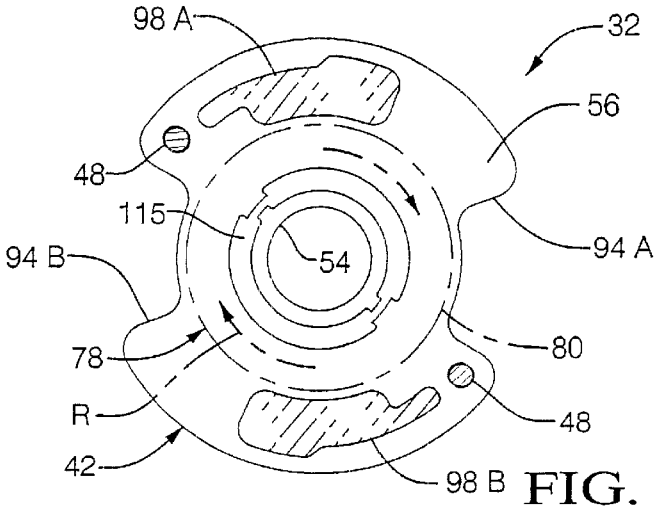
FIG. 4 is a sectional view taken generally along lines 4—4 of FIG. 1.

The cam ring 46 has an oval-shaped inner wall 52 that is circumferentially continuous and faces the longitudinal center line 50. The thrust plate 42 has an aperture or shaft bore 54 in line with the bore 14 of the housing 12. The thrust plate 42 has a first thrust face 56 facing the end wall 18 of the housing 12 and an axially opposite second thrust face 57 facing and bearing against an end 58 of the cam ring 46. The pressure plate 44 has a planar side 60 facing and bearing against an end 62 of the cam ring 58 and an annular shoulder 64 on which the cover 34 is seated. The oval-shaped inner wall 52 of the cam ring 46 and the planar sides 57, 60 of the thrust plate 42 and pressure plate 44 cooperate in defining a generally oval-shaped rotor chamber 66 of the cavity 20, as best shown in FIG. 3.

The cover 34 compresses the rotating group 32 against the end wall 18 of the cavity 20 to seal the rotor chamber 66 against fluid leakage against the planar side 57 of the thrust plate 42 and the end 58 of the cam ring 46 and between the planar side 60 of the pressure plate 44 and the end 62 of the cam ring 46. A retaining ring 68 is mounted in the cavity 20 to engage and prevent dislodgment of the cover 34 from the cavity 20. A discharge chamber 70 of the vane pump 10 is defined between the cover 34 and the pressure plate 44 and within the housing 12 around the drive shaft bore 14. A seal ring 72 suppresses fluid leakage between the cover 34 and the pressure plate 44.

A drive shaft 74 is jounaled by a bearing of the pump housing 12 for rotation about the longitudinal axis 50. A splined inboard end of the drive shaft 74 engages a splined bore 76 of a rotor 78 disposed in the rotor chamber 66 for rotation with the shaft 74 within the rotor chamber 66 about the longitudinal axis 50. An outboard end (not shown) of the drive shaft 74 is coupled to a rotary drive source, such a motor of a motor vehicle, when the vane pump 10 is employed for providing a source of pressurized fluid for a steering assist fluid motor of a motor vehicle.

The rotor 78 has a cylindrical outer surface 80 which is symmetric with respect to the longitudinal 50 of the pump 10. The rotor 78 has a pair of planar end walls 82A, 82B disposed in parallel planes perpendicular to the longitudinal axis 50. The end walls 82A, 82B of the rotor 78 are separated from the planar sides 60, 57 of the pressure plate 44 and the thrust plate 42 by respective ones of a pair of clearance dimensions $D_1$, $D_2$, illustrated in exaggerated fashion in FIG. 6. The outer surface 80 of the rotor 78 cooperates with the inner wall 52 of the cam ring 46 in defining a pair of crescent-shaped cavities 84A, 84B of the rotor chamber 66 on radially opposite sides of the rotor 78, as best illustrated in FIG. 3.

The rotor 78 is formed with a plurality of radial vane slots 86 which intersect the outer surface 80 and each of the end walls 82A, 82B. A corresponding plurality of flat vanes 88 are supported in respective ones of vane slots 86 for sliding radial reciprocation relative to the rotor 78. Each flat vane 88 has an outboard lateral edge 90 (FIG. 1) bearing against the oval-shaped inner wall 52 of the cam ring 46, and a pair of radial edges 92 (FIG. 5) separated from the planar side 66 of the pressure plate 46 and the planar side 57 of the thrust plate 44 by clearance dimensions $D_1$, $D_2$, respectfully (FIG. 6). The vanes 88 divide the crescent-shaped cavities 84A, 84B into a plurality of pump chambers 93 (FIG. 3) which expand in each of a pair of diagonally opposite inlet sectors of the crescent-shaped cavities, and collapse in each of a pair of diagonally opposite discharge sectors of the crescent-shaped cavities in conventional fashion concurrent with the direction of rotation R of the rotor 78.

The thrust plate 42 has a pair or diametrically opposed notches 94A, 94B which are open to the annular chamber 36. The pressure plate 44 has a pair of diametrically opposed notches 96A, 96B which are open to the annular chamber 36. The notches 94A, 96A and 94B, 96B are angularly aligned with the inlet sector of the crescent-shaped cavities 84A, 84B, respectively. The notches 94A, 96A and 94B, 96B define first and second inlet ports of the vane pump for directing hydraulic fluid from the chamber 36 into the rotor chamber 66.

Figure 2:
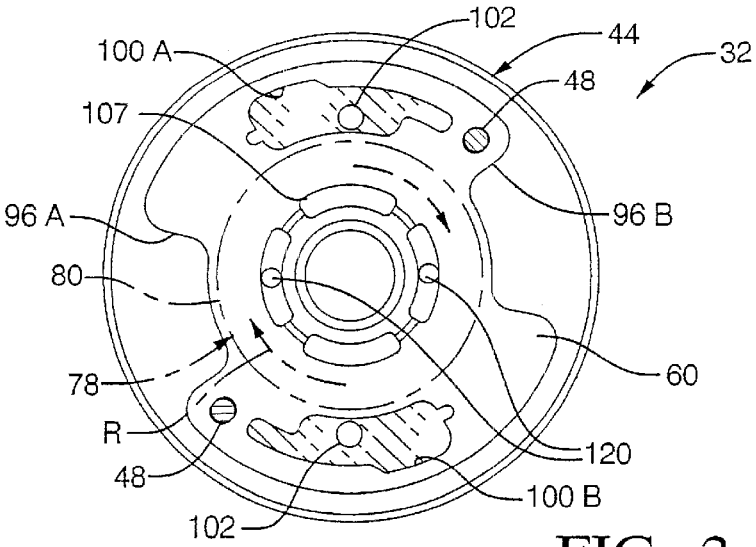
FIG. 2 is a sectional view taken generally along lines 2—2 of FIG. 1.
Figure 7:
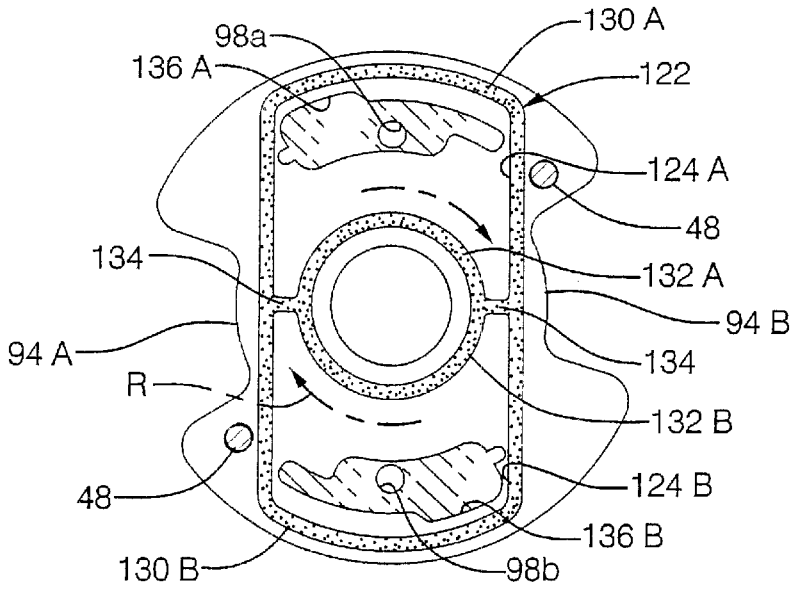
FIG. 7 is a sectional view taken generally along lines 7—7 of FIG. 1.
Figure 8:
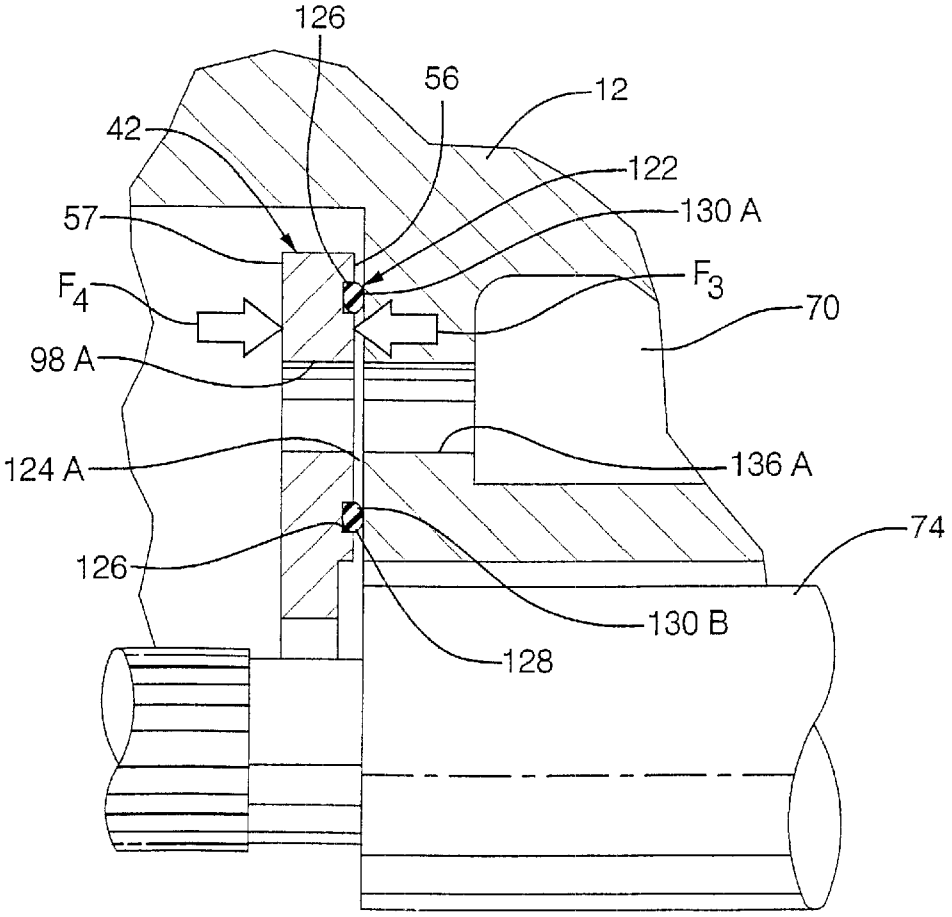
FIG. 8 is an enlarged fragmentary sectional view showing further features of the thrust plate and housing.

As shown best in FIGS. 1, 7, and 8, the thrust plate 42 has a pair of diametrically opposed through ports 98A, 98B extending through the plate 42 from in the second thrust face 57 thereof to the first thrust face 56. The pressure plate 44 has a pair of diametrically opposed shallow recesses or grooves 100A. 100B in the planar side 60 thereof which are angularly aligned with the ports 98A, 98B, respectively, and with the discharge sectors of the crescent-shaped cavities 84A, 84B, respectively. The shallow grooves 100A,100B communicate with the discharge chamber 70 through a pair of schematically represented passages 102 in the pressure plate 44, as shown best in FIGS. 1 and 2, and define respective ones of a pair of discharge ports of the vane pump 10. The discharge chamber 70 communicates with an external device, such as the aforementioned steering assist fluid motor (not shown) through a discharge passage (not shown) in the pump housing 12.

Figure 5:
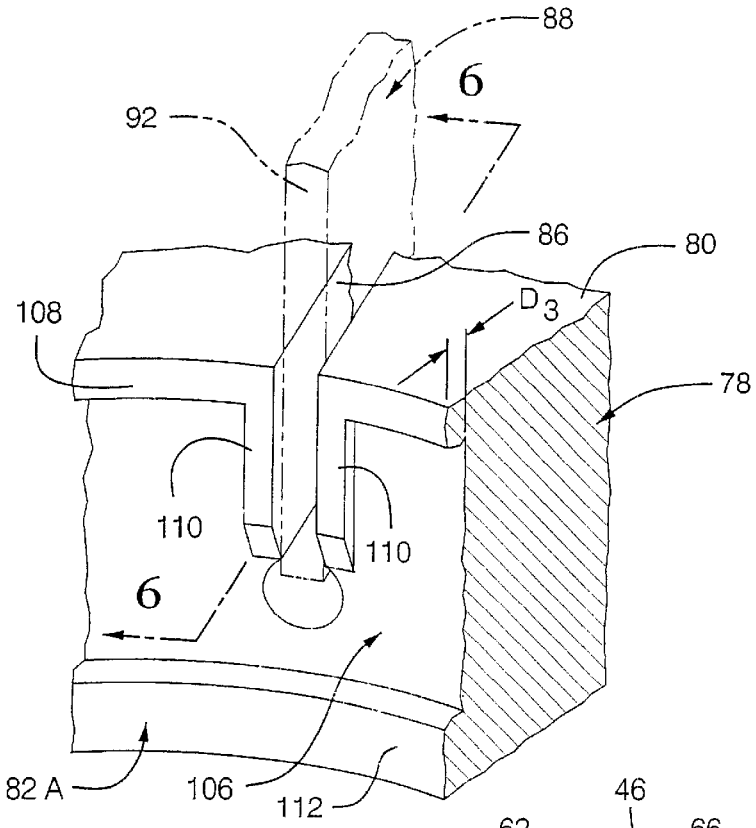
FIG. 5 is a fragmentary perspective view of a rotor.
Figure 6:
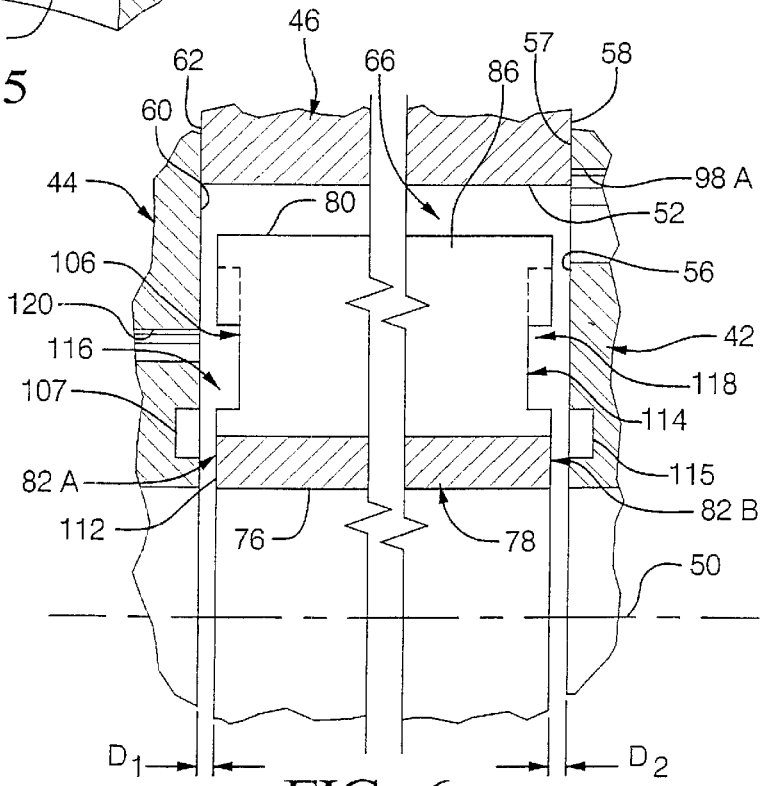
FIG. 6 is a fragmentary sectional view taken generally along lines 6—6 of FIG. 5.

As seen best in FIGS. 3, 5, and 6, the planar end wall 82A of the rotor is interrupted by an annular groove 106 having a depth dimension $D_3$ of about 1.0 mm which intersects each of the radial vane slots 86 and faces a groove 107 in the planar side 60 of the pressure plate opposite the inboard ends of the vane slots 86. Radially outboard of the annular groove 106, the end wall 82A of the rotor defines an annular outer land 108 between the annular groove and the cylindrical outer surface 80 of the rotor. The annular outer land 108 is interrupted by each of the radial vane slots and turns toward the longitudinal centerline 50 on opposite sides of each vane slot to define a plurality of pairs of radial lands 110 integral with the outer land. Radially inboard of the annular groove 106, the end wall 82A of the rotor defines an annular inner land 112 between the annular groove 106 and the splined bore 76 in the rotor. The surface area of the annular groove 106 between the outer land 108 and the inner land 112 constitutes a reaction portion of the planar end wall 82A of the rotor having a surface area of at least 30% of the surface area of the planar end wall 82A.

The planar end wall 82B of the rotor is interrupted by an annular groove 114, FIG. 6, identical to the annular groove 106 in the end wall 82A facing a groove 115 in the planar side 56 of the thrust plate opposite the inboard ends of the vane slots 86. The surface area of the annular groove 114 between outer and inner lands corresponding to the outer and inner lands 108, 112 constitutes a reaction portion of the planar end wall 82B of the rotor having a surface area of at least 30% of the surface area of the planar end wall 82B.

The groove 106 cooperates with the planar side 60 of the pressure plate in defining an annular first longitudinal balance chamber 116. The groove 114 cooperates with the planar side 56 of the thrust plate in defining an annular second longitudinal balance chamber 118. The first longitudinal balance chamber communicates with the discharge chamber 70 through a schematically represented passage 120 in the pressure plate. The second longitudinal balance chamber communicates with the first balance chamber 116 through the vane slots 86 under the vanes 88 therein.

The annular inner and outer lands 112, 108 cooperate with the planar side 60 of the pressure plate in defining fluid seals on opposite sides of the annular groove 106 even though separated by the clearance dimension $D_1$. Likewise, the inner and the outer lands on opposite sides of the annular groove 114 in the end wall 82B of the rotor cooperate with the planar side 56 of the thrust plate in defining fluid seals on opposite sides of the annular groove 114 even though separated from the planar side 56 by the clearance dimension $D_2$. The close fit between the vanes 88 and the vane slots 86 suppresses fluid leakage from the balance chambers through the vane slots. The outer lands also separate the first and the second balance chambers from the aforesaid inlet and discharge ports of the vane pump.

As shown best in FIGS. 1, 7 and 8, a resilient gasket or seal 122 fabricated of a suitable rubber or synthetic plastic material resistant to hydraulic fluid is disposed between the first thrust face 56 of the thrust plate 42 and the facing end wall 18 of the housing 12. The gasket 122 is compressed between the thrust plate 42 and housing end wall 18 and defines at least one and preferably at least two bounded, sealed balance chambers 124A, 124B which are isolated by the gasket 122 from the chamber 36 and the drive shaft bore 14 of the housing 12. The thrust plate 42 preferably is formed with grooves 126 in the first thrust face 56 which outline the balance chamber regions 124A, 124B. The gasket 122 is accommodated in the grooves 126, with a sealing portion 128 of the gasket 122 projecting out of the grooves 126 beyond the first thrust face 56 for sealing contact with the end wall 18 of the housing 12. The grooves 126 and gasket 122 disposed therein are arranged to surround the through ports 98A, 98B of the thrust plate 42, as shown best in FIG. 7, such that the through ports 98A, 98B open into the balance chambers 124A, 124B on the first thrust face 56 for the containment of high pressure hydraulic fluid at the discharge pressure across an area of the thrust face 56 substantially greater than that of the area occupied by the through ports 98A, 98B. The size and shape of the balance chambers 124A, 124B are selected to capture within the balance chambers 124A, 124B a volume of the high pressure hydraulic fluid under the discharge pressure which is distributed evenly across the area of the first thrust face surface 56 confined by the balance chambers 124A, 125B and exerts an axial hydraulic balancing force $F_3$ (FIGS. 1 and 8) in the axial direction against the first thrust face 56 which is preferably equal to and counteracts the hydraulic fluid force $F_4$ exerted on the second thrust face 57 from the rotor chamber 66, so as to balance the thrust plate 42 in hydraulic equilibrium in the direction of the axis 50, as will be explained in greater detail below.

In operation, fluid at substantially atmospheric pressure is delivered to the annular chamber 36 around the rotating group through the inlet passage 28, the aperture 30, and the internal passage 26 in the pump housing 12. As the drive shaft 74 rotates the rotor 78, the expanding pump chamber 93 in the inlet sectors of the crescent-shaped cavities 84A, 84B are filled with hydraulic fluid through the inlet ports defined by the notches 94A, 96B and 94A, 96B. The fluid in the pump chambers is transported by the rotor 78 to the discharge sectors of the crescent-shaped cavities 84A, 84B and expelled through the discharge ports 98A, 98B of the thrust plate 42 and the recesses 100A, 100B of the pressure plate 44 into the discharge chamber 70. The fluid pressure prevailing in the discharge chamber 70 is a high discharge pressure of the vane pump 10. The discharge chamber 70 is connected to the aforementioned steering assist fluid motor or similar device through a flow control valve, not shown, in the bore 24 of the housing 12. The flow control valve maintains a substantially rate of fluid flow from the vane pump 10 by recirculating a fraction of the fluid expelled from the pump chambers back through the annular chamber 36 around the rotating group through the internal passage 26 and the pump housing 12.

The fluid in the discharge chamber induces a net pressure force on the pressure plate 44 represented by a schematic force vector $F_1$, FIG. 1, which reacts evenly across the exposed area of the pressure plate. The net pressure force represented by the schematic vector $F_1$ thrusts the rotating group toward the flat bottom 18 of the counterbore 20 for enhanced suppression of fluid leakage from between the planar side of the thrust plate and the end 58 of the cam ring and between the planar side of the pressure plate and the end 62 of the cam ring.

At the same time, fluid at the discharge pressure of the pump is conducted or ported to the annular first balance chamber 116 through the passages 102 in the pressure plate and from the first balance chamber into the second balance chamber 118 through the vane slots 86 under of the flat vanes 88. The fluid pressure under the flat vanes thrusts the outboard lateral edges 90 of the vanes against the oval-shaped wall 52 of the cam ring to suppress fluid leakage from the pump chambers 93 between the vanes and the oval-shaped wall.

The fluid pressure in the first balance chamber 116 of the rotor 78 induces a net pressure force on the pressure plate represented by a schematic force vector $F_2$ opposite to the net pressure force represented by the schematic vector $F_1$. The fraction of the net pressure force represented by the schematic vector $F_1$, reacting on the pressure plate within the silhouette of the oval-shaped rotor chamber 66 is effectively offset or balanced by the net pressure force represented by the schematic vector $F_2$ because the reaction portion of the planar end wall 82A of the rotor constitutes a substantial fraction of the area of the silhouette of the rotor chamber 66. Accordingly, the flexure of the pressure plate 44 into the rotor chamber characteristic of the prior van pumps referred to above is substantially reduced so that the clearance dimension $D_1$ is smaller than corresponding clearance dimensions in such prior van pumps for improved volumetric efficiency.

The fluid pressure in the first balance chamber 116 also reacts against the reaction portion of the planar end wall 82A of the rotor and thrusts the rotor toward thrust plate. Concurrently, however, the same fluid pressure in the annular second balance chamber 118 reacts against the reaction portion of the opposite end wall 82B of the rotor and thrusts the rotor toward the pressure plate. Because the reaction portions of the planar first and second end walls of the rotor are equal, the net pressure force on the rotor attributable to fluid in the annular first balance chamber equal s the net pressure force on the rotor attributable to fluid in the annular second balance chamber. Accordingly, the rotor is suspended longitudinally in static equilibrium between the planar sides of the pressure plate and the thrust plate with the substantially equal clearance dimensions $D_1$, $D_2$ minimizing both sliding friction and fluid leakage between the rotor and the flat vanes thereon and the planar sides of the thrust plate and the pressure plate.

The fluid in the discharge sectors exerts a hydraulic pressure force $F_3$ on the second thrust face 57 of thrust plate 42 which urges the thrust plate 42 axially away from the rotor 78 and cam ring 46 toward the end wall 18 of the housing 12.

The balance chambers 124A, 124B defined on the opposite first thrust face 56 of the thrust plate 42 enclose a sealed space in fluid communication with fluid at the discharge pressure through the ports 98A, 98B in the thrust plate 42 and through flow passages 136A, 136B formed in the housing 12 (FIGS. 1 and 8) which extend from the discharge chamber 70 through the end wall 18 for porting the high pressure hydraulic fluid to the sealed balance chambers 124A, 124B to exert the counteracting balance force vector $F_4$ in opposition to the opposing force vector $F_3$. As mentioned, the size and shape of the balance chambers 124A, 124B and thus the shape of the grooves 126 and gasket 122 are engineered to provide a counteracting force $F_4$ to the opposing force $F_3$ so as to balance the thrust plate 42, placing it in a state of hydraulic equilibrium in the axial direction within the cavity 20 of the housing 12. One such shape is illustrated in FIG. 7, although it will be appreciated that the invention is not limited to this particular gasket configuration. The gasket 122 of the illustrated embodiment includes an outer perimeter portion 130A, 130B which generally traces but is spaced inwardly of the outer perimeter of the thrust plate 42 so as to isolate the chambers 124A, 124B from the thrust plate notches 94A, 94B and the dowel pins 48. The gasket 122 includes an inner perimeter seal portion 132A, 132B which encircles the drive shaft bore 54 of the thrust plate 42. The outer and inner seal portions are joined by a transverse bridge portion 134 to partition the area between the outer and inner perimeter portions into a pair of adjacent balance chamber portions denoted as 124A, 124B. Each balance chamber portion 124A, 124B has associated therewith the aforementioned fluid passages 136A, 136B fluid inlet port of the housing 12 (FIGS. 1 and 8) for communicating the high pressure hydraulic fluid into the chamber portions 124A, 124B. The gasket 122 keeps the high pressure fluid from escaping the balance chambers 124A, 124B into the chamber 36 or drive shaft bore 14. Accordingly, the thrust plate 42 is supported axially in static equilibrium, minimizing or altogether eliminating axial distortion of the thrust plate 42 and fluid leakage between the flat vanes 88 and the second thrust face 57 of the thrust plate 42, thereby increasing the volumetric efficiency of the vane pump 10.

The hydraulically balanced thrust plate 42 has been surprisingly shown to perform best when used in combination with the hydraulically balanced rotor 78. The balanced thrust plate 42 has shown to improve volumetric efficiency of a vane pump by about 20% when used with a conventional non-hydraulically balanced rotor. A gain in volumetric efficiency of about 58% was shown when the hydraulically balanced thrust plate 42 was used together with the hydraulically balanced rotor 78.

The disclosed embodiments are representative of presently preferred forms of the invention, but are intended to be illustrative rather than definitive thereof. The invention is defined in the claims.

What is claimed is:

1. A vane pump comprising:

a pump housing having a longitudinal axis, a cavity for fluid, and an end wall of said housing exposed to said cavity;

a thrust plate disposed in said cavity having a first thrust face disposed in adjacent facing relation to said end wall of said housing and a second thrust face axially opposite said first thrust face;

a pressure plate disposed in said cavity in axially spaced relation to said thrust plate;

a cam ring disposed in said cavity between said thrust plate and said pressure plate, said cam ring having an inner cam wall defining a rotor chamber of said cavity;

a rotor supported in said rotor chamber for rotation about said longitudinal axis relative to said inner cam wall of said cam ring;

a plurality of vanes slideably supported by said rotor for radial reciprocation in communication with said inner cam wall of said cam ring operative to draw relatively low pressure fluid into said rotor chamber and expel the fluid under relatively high discharge pressure from the rotor chamber; and a resilient gasket disposed between said first thrust face of said thrust plate and said end wall of said housing defining at least one sealed balance chamber for accommodating a fraction of the high pressure fluid between said first thrust face and said end wall of said housing, said resilient gasket including an inner circumferentially continuous seal portion, an outer circumferentially continuous seal portion, and a bridge portion extending between said inner and outer circumferentially continuous seal portions partitioning said at least one balance chamber into adjacent balance chamber portions separated from one another by said bridge portion.

2. A vane pump comprising:

a pump housing having a longitudinal axis, a cavity for fluid, and an end wall of said housing exposed to said cavity;

a thrust plate disposed in said cavity having a first thrust face disposed in adjacent facing relation to said end wall of said housing and a second thrust face axially opposite said first thrust face;

a pressure plate disposed in said cavity in axially spaced relation to said thrust plate;

a cam ring disposed in said cavity between said thrust plate and said pressure plate, said cam ring having an inner cam wall defining a rotor chamber of said cavity;

a rotor supported in said rotor chamber for rotation about said longitudinal axis relative to said inner cam wall of said cam ring;

a plurality of vanes slideably supported by said rotor for radial reciprocation in communication with said inner cam wall of said cam ring operative to draw relatively low pressure fluid into said rotor chamber and expel the fluid under relatively high discharge pressure from the rotor chamber;

a resilient gasket disposed between said first thrust face of said thrust plate and said end wall of said housing defining at least one sealed balance chamber for accommodating a fraction of the high pressure fluid between said thrust face and said end wall of said housing, and at least one balance chamber formed between said rotor and said second thrust face of said thrust plate in open fluid communication with said at least one balance chamber formed between said first thrust face of said thrust plate and said end wall;

said resilient gasket includes at least one circumferentially continuous seal portion;

a rotary shaft extending into said rotor chamber through a shaft opening in said thrust plate and mounting said rotor, said at least one circumferentially continuous seal portion including an inner seal portion extending about said rotary shaft and a circumferentially continuous outer seal portion spaced from said inner seal portion; and wherein said resilient gasket includes a bridge portion extending between and interconnecting said outer and inner seal portions.

3. The vane pump of claim 2 wherein said resilient gasket is carried by and extends outwardly of said first thrust face of said thrust plate.

4. The vane pump of claim 2 wherein said thrust plate includes through-ports in communication with said balance chamber.

5. The vane pump of claim 2 wherein said bridge portion partitions said balance chamber into adjacent balance chamber portions separated from one another by said bridge portion.

6. The vane pump of claim 2 wherein said first thrust face is formed with a groove, and said resilient gasket is disposed in said groove and includes and exposed sealing portion sealingly engaging said end face of said housing.

7. The vane pump of claim 2 wherein said housing includes at least one fluid port in communication with said at least one balance chamber for supplying high pressure fluid to said balance chamber.

8. The vane pump of claim 2 wherein said thrust plate includes a pair of radially opposed notches and a central shaft opening spaced from said notches for receiving said rotary shaft.

9. The vane pump of claim 8 wherein said resilient gasket seals said notches and said shaft opening from said balance chamber.

10. The vane pump of claim 9 wherein said thrust plate includes a pair of fluid ports disposed on radially opposite sides of said shaft opening in circumferentially spaced relation to said notches and extending through said thrust plate between said opposite thrust faces.

11. The vane pump of claim 10 wherein said balance chamber includes chamber portions on said first thrust face radially aligned with said fluid ports of said thrust plate.

* * * * *